US006164219A

United States Patent [19]

Green

[11] Patent Number: 6,164,219

[45] Date of Patent: Dec. 26, 2000

[54] SECURITY VAULT

[75] Inventor: John Richard Green, 6331 Mesa Court, Burnaby, British Columbia, Canada, V5E 3W4

[73] Assignee: John Richard Green, Richmond, Canada

[21] Appl. No.: 09/115,152

[22] Filed: Jul. 14, 1998

Related U.S. Application Data

[63] Continuation-in-part of application No. 08/738,436, Oct. 25, 1996, Pat. No. 5,778,805.

[51] Int. Cl.[7] ..... E05B 15/02; E06B 1/04

[52] U.S. Cl. ..... 109/73; 70/417; 70/418; 109/74; 109/77; 292/346; 312/257.1

[58] Field of Search ..... 109/74, 77, 58, 109/73; 70/417, 418; 312/257.1, 263; 292/346

[56] References Cited

U.S. PATENT DOCUMENTS

| | | | |
|---|---|---|---|
| 1,404,044 | 1/1922 | Millice | 109/74 |
| 1,428,340 | 9/1922 | Melink | 109/74 |
| 1,473,117 | 11/1923 | Melink | 109/74 |
| 2,387,172 | 10/1945 | Molser et al. | 109/74 |
| 3,831,408 | 8/1974 | Featherunan | 70/278 X |
| 4,083,424 | 4/1978 | von den Stemmen et al. | 70/278 X |
| 4,524,904 | 6/1985 | Masse et al. | 232/7 |
| 4,669,394 | 6/1987 | Fogleman et al. | 70/278 X |
| 4,741,275 | 5/1988 | Lewiner et al. | 109/7 |
| 4,887,445 | 12/1989 | Beatty | 70/278 |
| 4,898,010 | 2/1990 | Futami et al. | 70/257 X |
| 4,926,762 | 5/1990 | Paul | 109/51 |
| 5,056,342 | 10/1991 | Prinz | 109/51 X |
| 5,164,718 | 11/1992 | Cedergren | 340/825.31 |
| 5,199,361 | 4/1993 | Robinson | 109/51 |
| 5,389,919 | 2/1995 | Warren et al. | 70/278 X |
| 5,544,595 | 8/1996 | Stephenson, III et al. | 109/74 |
| 5,595,081 | 1/1997 | Nuzzo et al. | 70/446 |
| 5,778,805 | 7/1998 | Green | 109/51 |

*Primary Examiner*—Lloyd A. Gall
*Attorney, Agent, or Firm*—John Russell Uren

[57] ABSTRACT

Security vault to protect valuable items. The vault has a redundant number of members which combine to deter the entry and subsequent attempted damage to or destruction of the vault. A body has an open end which is surrounded by a strength band connected to the body. A recess is defined between the strength band and the open end of the body. A door to the vault has open and closed positions and, in the closed position, an edge extension of the door enters into the recess. Rod loops are connected between the body and the strength band and act as locking members for complementary pawls which are mounted on the interior of the door.

18 Claims, 8 Drawing Sheets

SECURITY VAULT

CROSS-REFERENCE TO RELATED APPLICATION

This is a continuation-in-part of application Ser. No. 08/738,436 filed Oct. 25, 1996 now issued as U.S. Pat. No. 5,778,805.

This invention relates to an apparatus for securing items and valuables in a vehicle and, more particularly, to a vehicle security vault for securing vehicular valuables.

BACKGROUND OF THE INVENTION

Vaults and lock boxes are a common means of security one's valuables. For example, valuables may be secured in a safety deposit box or in safes. However, valuables transported in vehicles do not have these measures available to protect valuables from "smash and grab" vehicle robberies. Stereos, compact discs, cellular phones, purses, cameras, and similar valuables may be at risk.

Although car alarms are available, a "smash and grab" thief may not be deterred since a vehicle door lock may be quickly punched out or a window may be broken in order to grab any valuables within reach.

Valuables are also commonly placed in the glove compartment of a vehicle. Glove compartments, however, offer limited storage space and structural integrity is lacking. A locked glove compartment can be broken into easily with a crowbar or screwdriver.

Valuables may also be stored in vehicle trunks. However, many vehicles such as pickup trucks, minivans, and hatchbacks lack such trunks. Further, a thief can obtain access to the trunk without considerable difficulty.

U.S. Pat. No. 4,926,762 entitled SECURITY SAFES FOR VEHICLES (Paul) teaches two embodiments of a lightweight security safe for use in vehicles. A twelve (12) gauge thick steel boxlike housing with welded seams is disclosed. A rectangular steel tubing framework around the access opening provides is reinforcement around the locked door and a strong location to mount a full length piano type door hinge. Each door and hinge is slightly recessed to prevent thieves from prying on the edges of the door. Paul further teaches a heavy duty combination lock mounted on the back of the door for locking an accessible door handle and handle rod. A crank-and-rod system is attached to the handle assembly in the interior of the door. The crank-and-rod assembly is further attached to, and actuates a multiple of lock pins extendable from two oppositely disposed edges of the door. Further, the safe is lined in the interior with a first layer of fire-resistant mineral fiber material, covered with a layer of carpet. However, Paul contemplates a nonremovable apparatus, securely bolted to the vehicle with carriage bolts. The safe cannot be readily removed and placed at another location. Further, the safe door must be manually locked after the door is closed.

SUMMARY OF THE INVENTION

According to the invention, there is provided a security vault to protect valuables comprising a body having an open end, a strength band surrounding the perimeter of said body at said open end and being connected to said body, a door operably mounted in said open end of said body defining open and closed positions and having an edge portion, said strength band and said body defining a recess between said strength band and said body, said edge portion of said door being operable to enter said recess when said door in said closed position.

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT

Figure 1:
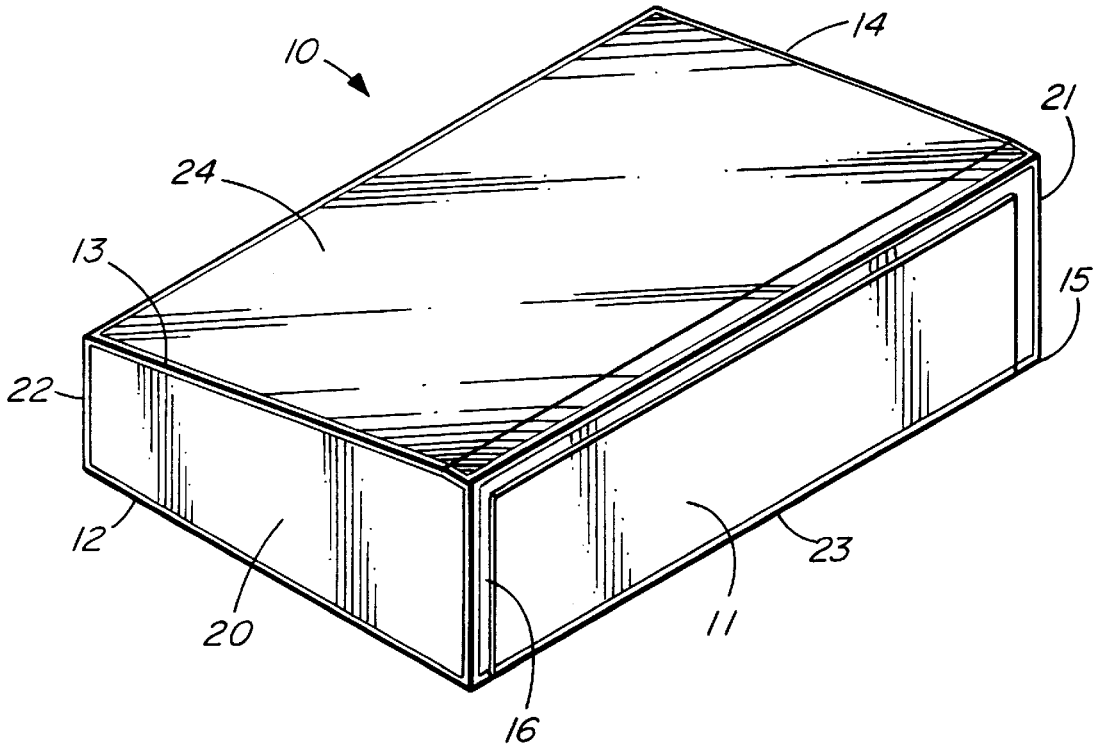
FIG. 1 is a diagrammatic isometric view of the vehicle security vault according to the present invention.

Referring now to the drawings, FIG. 1 illustrates a fabricated metal vehicle security vault generally illustrated at 10 and a recessed steel vault door 11 is provided and opens and closes to allow access to the interior of the vault 10. The fabricated metal security vault 10 is fully welded on all corners 12, 13, 14, 15 and is one-sixteenth (1/16) of an inch in thickness. The steel door 11 is one-eighth (1/8) of an inch thick, and is reinforced with a square steel door frame 16.

The inside dimensions of the security vault 10 are conveniently approximately twenty-seven (27) inches by seventeen (17) inches by five (5) inches.

Figure 2A:
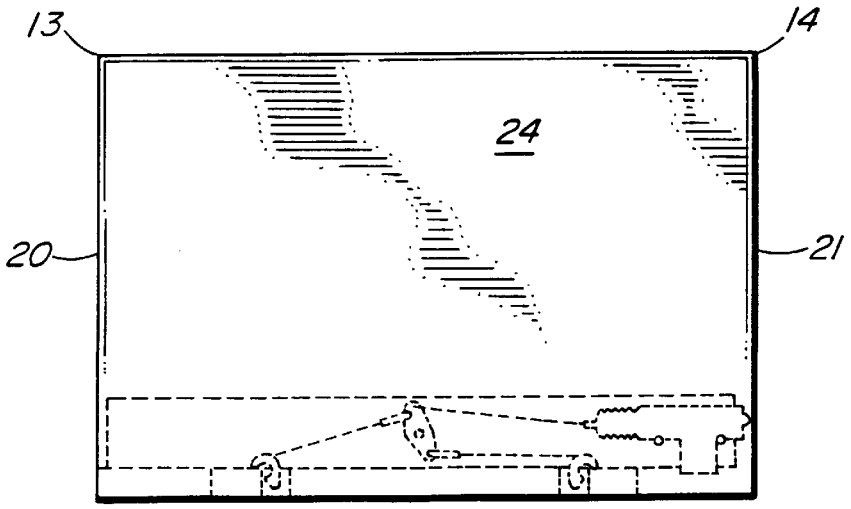
FIGS. 2A, 2B and 2C are, respectively, plan, front and side views of the internal door actuating mechanism of the security vault according to the invention.
Figure 2B:
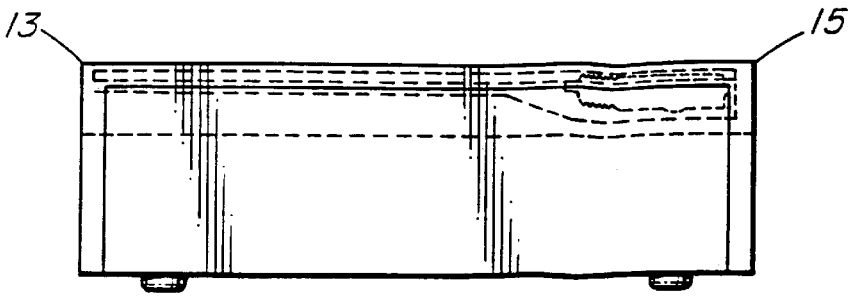
Figure 2C:
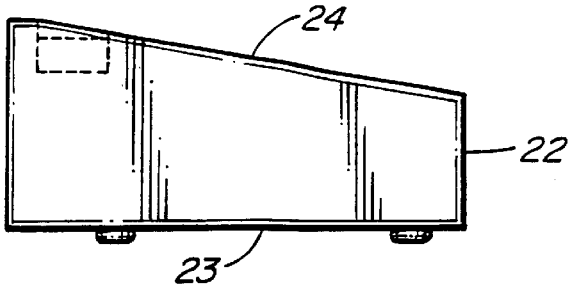
Figure 3:
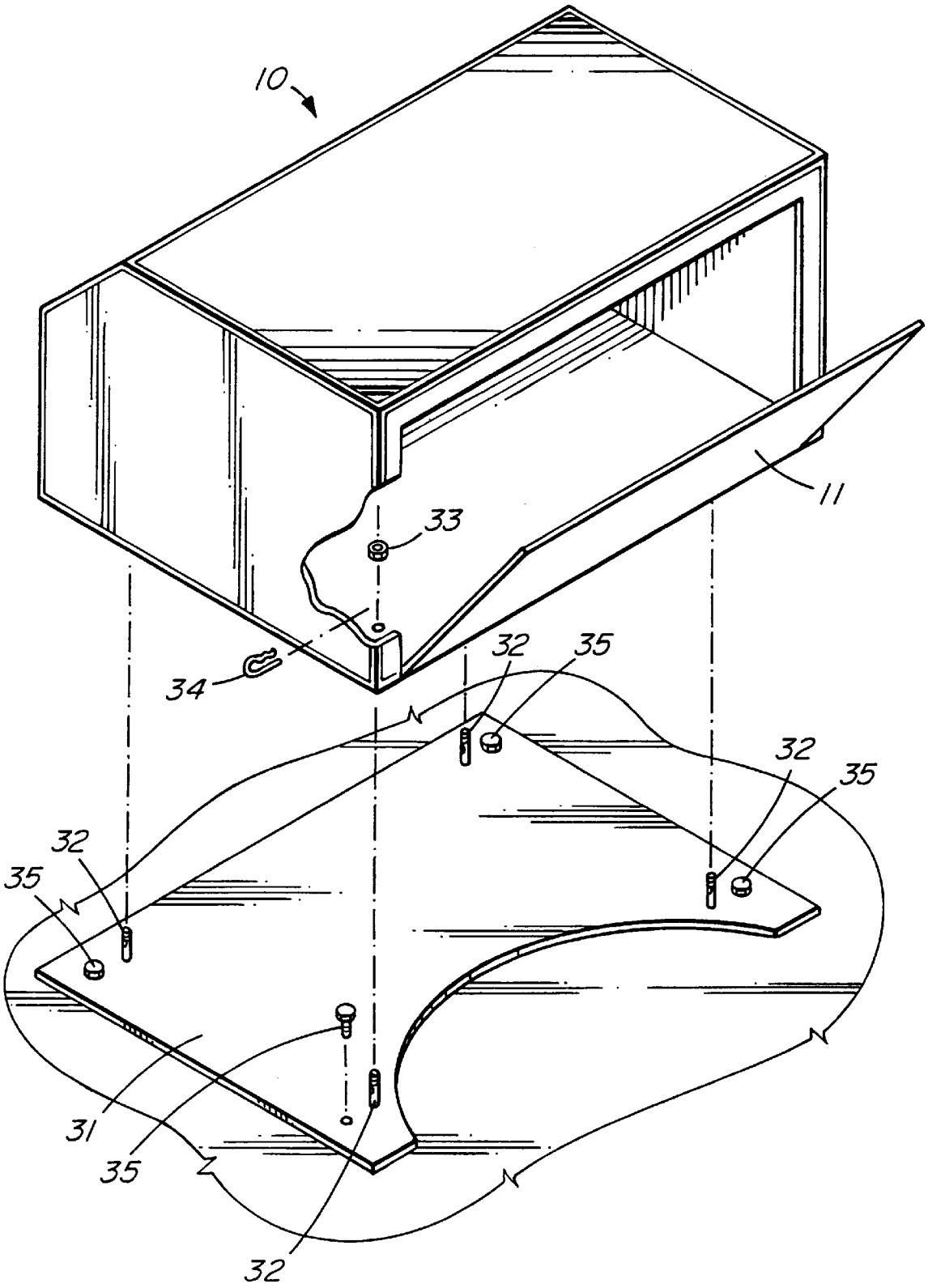
FIG. 3 is a diagrammatic isometric view of the mounting mechanism of the security vault according to the invention.

The exterior configuration of the security vault 10 is shown in FIGS. 2A through 2C. Side panels 20, 21 are parallel and perpendicular to back panel 22. Back panel 22 is parallel to the hinged openable vault door 11 on the front of the security vault 10 (FIG. 3). Bottom panel 23 is perpendicular to the side panels 20,21. Top panel 24 is hot parallel to the bottom panel 30 as clearly seen in FIG. 1. Top panel 24 slopes to make more efficient use of the space under the seats of mini-vans where the vault 10 is intended to be located (FIGS. 2A–2C). The vault 10 may be manufactured in other geometries to more efficiently use the space available at other potential mounting locations. For example, the vault 10 illustrated in FIG. 3, without a gradually sloping top panel 24, is specifically designed to be mounted in trucks.

Vehicle security vault 10 is mounted on a mounting plate 31. Mounting plate 31 is attached to the vehicle, as illustrated in FIG. 3, using mounting bolts 35. Mounting plate 31 and vault 10 may be located under the back seat of mini-vans, in the trunk of vehicles, or in any other convenient location.

Mounting bolts 35 securing mounting plate 31 to the vehicle are only exposed when the security vault 10 is removed.

The vehicle security vault is removable, provided that the user can open the vault 10. Mounting studs 32 holding the security vault 10 to the mounting plate 31 are accessible when the vault door 11 is open. Mounting studs 32 may be cross drilled to utilize quick release fasteners 34 rather than conventional threaded fasteners 33. Quick release fasteners 34 permit convenient removal of the security vault 10 to another mounting plate 31 at a different location.

Figure 5:
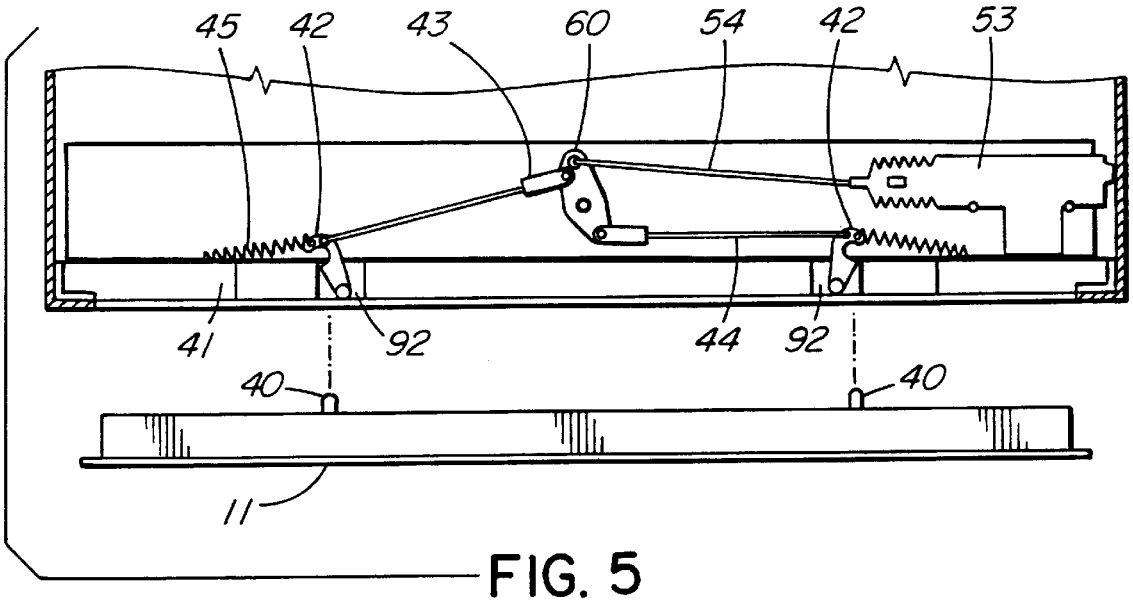
FIG. 5 is a diagrammatic view of the pull-only link and clevis assembly for the door of the security vault.
Figure 6A:
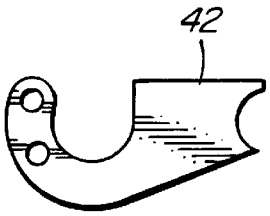
FIGS. 6A and 6B are, respectively, detail views of the latch hook and toggle plate according to the invention.
Figure 6B:
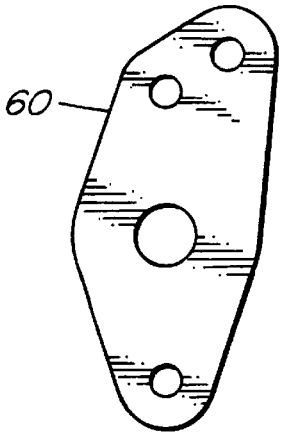
Figure 7A:
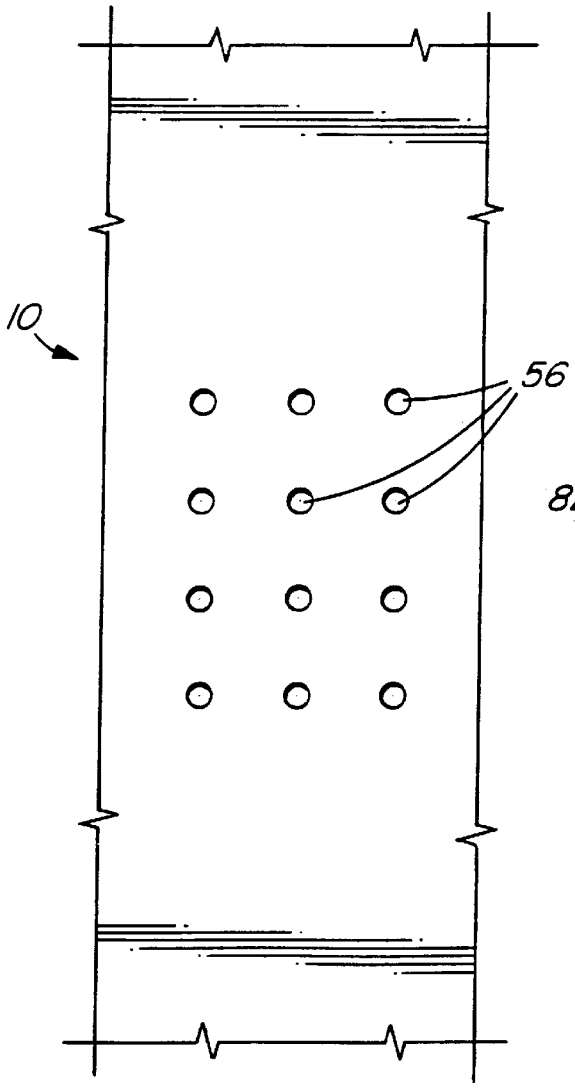
FIGS. 7A and 7B are diagrammatic plan and a sectional side view, respectively, of the internal secondary keypad mounting in the vehicle security vault.
Figure 7B:
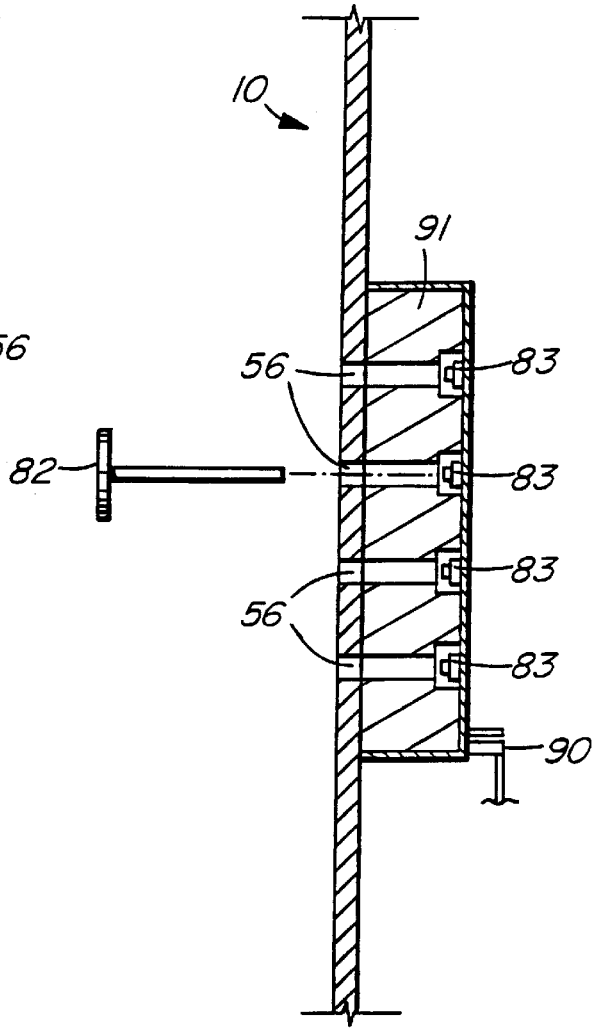

When the recessed vault door 11 is closed, two door-mounted pins 40 (FIG. 5) pass through slots 92 in the lock block 41. The latch hooks 42 (which are normally held in the closed position by light springs 45) are rotated by the door pins 40. Link and clevis assemblies 41,44 are attached to the latch hooks 42. When the vault door 11 is fully closed, latch hooks 42 are biased to the closed position by light springs 45, thereby engaging the door pins 40.

Figure 4:
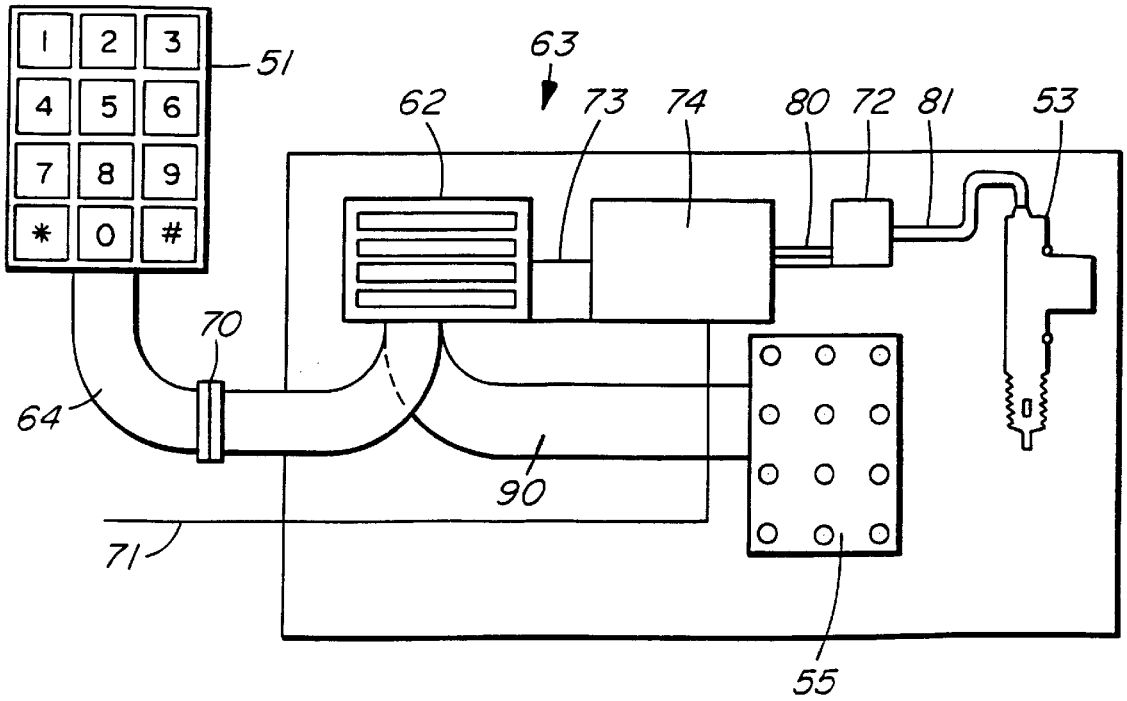
FIG. 4 is a diagrammatic illustration of the keypad, code selector array, and the door actuator used for the security vault of the invention.

An electronic lock code sequence is used to open the locked security vault 10. Code sequence can be determined by the user selecting switches on the code selector array 62 corresponding to numbers on the key pad 51 (FIG. 4). All electronics are securely contained within the security vault 10.

An individual attempting to access the vehicle security vault 10 must first activate power to turn the unit on. Power can only reach the solenoid door actuator 53 after the electronic switching circuit 63 has been activated. The user then enters the code sequence into the externally located keypad 51. Keypad 51 may be externally mounted on the security vault 10 or located elsewhere in the vehicle. Keypad 51 is connected to electronic components in the interior of the security vault 10 by a data-only, multi-wire cable 64 with a quick connector 70. If keypad 51 is vandalized, the quick connector 70 permits replacement.

In the event keypad 51 is disabled, an internally mounted secondary keypad 55 can be used. Secondary keypad 55 is mounted on the interior of the back panel 22. Secondary keypad 55 is only accessible through small keypad guide holes 56 in the security vault 10 casing. The guide holes 56 are concealed under a label. A thin plunger 82 is required to depress the secondary keypad switches 83 through the multitude of keypad guide holes 56. Secondary keypad control lines 90 lead to the code selector array 62.

Quick connector 70 and data-only multi-wire cable 64 connect to the code selector array 62 so vault door 11 cannot be activated by connecting power to individual wires. Further, the sole power wire 71 supplying the security vault 10 also powers the relay 72 to the solenoid door actuator 53. Severing the power wire 71 would ensure that the vault door 11 will not open.

When the code sequence is correctly entered, an electronic circuit is activated (FIG. 4). Signals from the keypad 51 are filtered by the code selector array 62. The electronic code sequence must be entered correctly, or the keypad 51 (or secondary keypad 55) resets and the entire code sequence must be re-entered. Further, the user must enter the code sequence in a limited amount of time, or the keypad 51 (or secondary keypad 55) resets and the user must re-enter the entire code sequence. Filtered signals from the code selector array 62 pass through the code control lines 73 into the central control unit 74. The central control unit 74 utilizes integrated circuit technology to activate a relay 72 through the relay control lines 80. Once activated, the relay 72 activates the solenoid door actuator 53 via the actuator control lines 81.

To open the vault door 11, solenoid door actuator 53, activated by the electronic circuit, pulls on an attached rod 54 for a very short period. The resulting solenoid motion causes rod 54 to rotate the attached toggle 60 and pulls both link and clevis assemblies 43,44 pulling the latch hooks 42 out the path of the door pins 40. A door spring (not illustrated), is conveniently mounted on the face of the vault door 11 to push the door pins 40 past the latch hooks 42 and allows the vault door 11 to fall open fully. A pneumatic strut(not illustrated) maybe conveniently attached to the vault door 11 and the lock box 10 prevents the vault door 11 from opening abruptly and causing injury.

OPERATION

In operation, the fabricated metal vehicle security vault 10 is mounted in a vehicle. A user places valuables inside vehicle security vault 10 upon leaving the vehicle. The vault door 11 is shut, thereby locking the vehicle security vault 10.

A thief attempting to pry open the vehicle security vault 10 will find that the durable metal construction of the vault 10 resists such conventional methods of intrusion. Recessed vault door 11 and steel door frame 16 resist attempts to pry open the vault door 11.

A thief attempting to circumvent keypad 51 access may vandalize keypad 51 and connect power to the attached multi-wire cable 64. The multi-wire cable 64 exclusively conveys data, so a thief cannot activate the door 11 in this manner. A thief may sever the power wire 71 to the vault 10, but without power the vault door 11 will not open.

When the user returns to the vehicle, a code, is entered on the keypad 51. The code sequence must be entered correctly, in a limited or predetermined period of time, or the keypad 51 resets and the code sequence must be re-entered. In the event the keypad 51 has been vandalized, the user may enter the code sequence on the secondary keypad 55, using a thin plunger 82. The secondary keypad 55 is mounted inside the security vault 10, on the back panel 22. The secondary keypad 55 is only accessible through keypad guide holes 56 in the vault 10 casing. To avoid detection by thieves, the secondary keypad 55 is conveniently concealed beneath a label (not illustrated).

When the code sequence is successfully entered, the security vault 10 opens and the user may retrieve the items stored inside.

Alternatively, while the vehicle security vault 10 is primarily intended to be located within a vehicle, the vault 10 and mounting plate 31 may be placed at locations other than within a vehicle.

Further, while quick release fasteners 34 are contemplated to secure the vehicle security vault 10 to the mounting plate 31 by way of mounting studs 32, conventional threaded fasteners 33 may alternatively be used.

While the secondary keypad 55 is conveniently mounted on the interior of the back panel 22 of the vault 10, it could be positioned in other locations as well, such as the top panel 24 or side panels 20, 21 of the vault 10.

Yet a further embodiment of the invention is illustrated in FIGS. 8 through 13. In this embodiment, the security vault generally illustrated at 100 does not have electronic opening and closing. Because of its manual operation, the configuration of the security vault 100 according to this embodiment takes on a unique construction.

Figure 8:
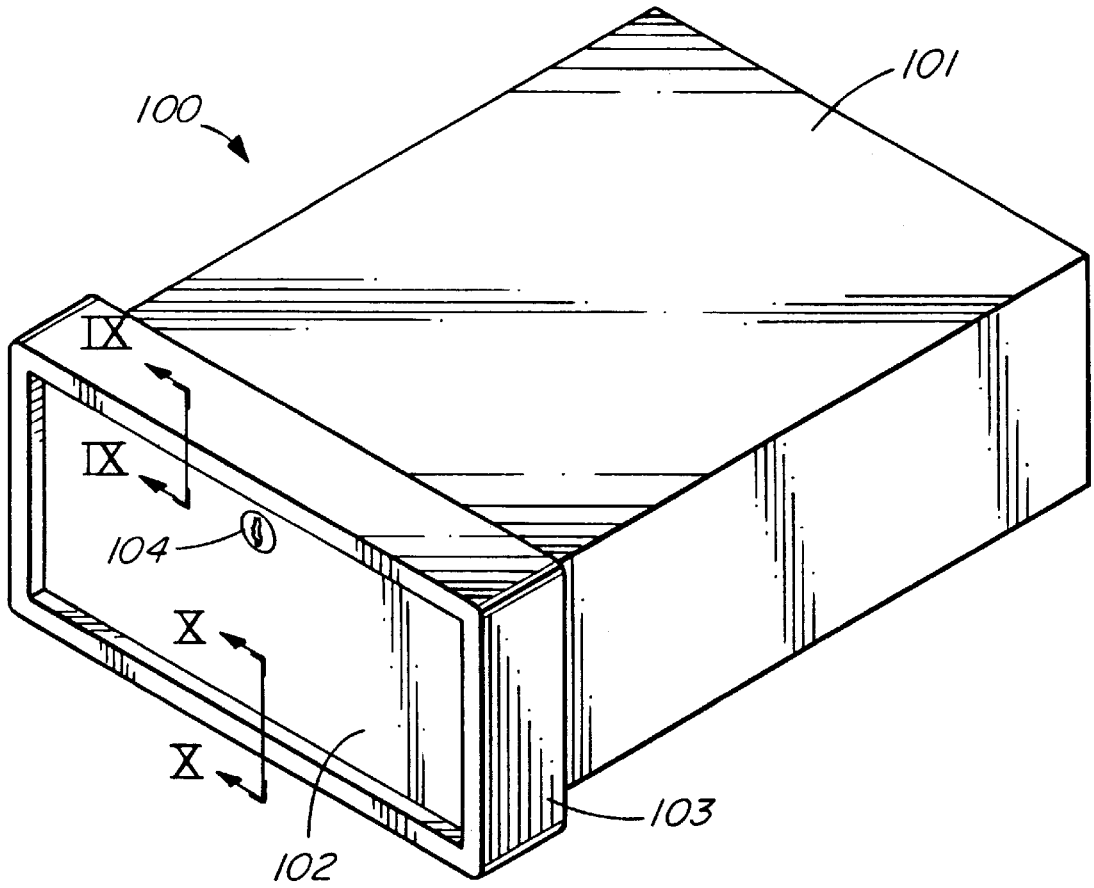
FIG. 8 is a diagrammatic isometric view of the security vault according to a further aspect of the invention.

Referring to FIG. 8, the security vault 100 comprises a body 101 and a door 102 which is hinged at the bottom as will be explained. A strength band 103 surrounds the body 101 at the open end of the body 101 and the door 102 fits into a recess between the strength band 103 and body 101 as also will be described. Door 102 is recessed behind the front plane of the strength band 103 to reduce any leverage which an inserted tool may need in any attempt to pry open the door 102. A keylock 104 is used to rotate a pawl assembly generally illustrated at 110 in FIG. 12.

Figure 12A:
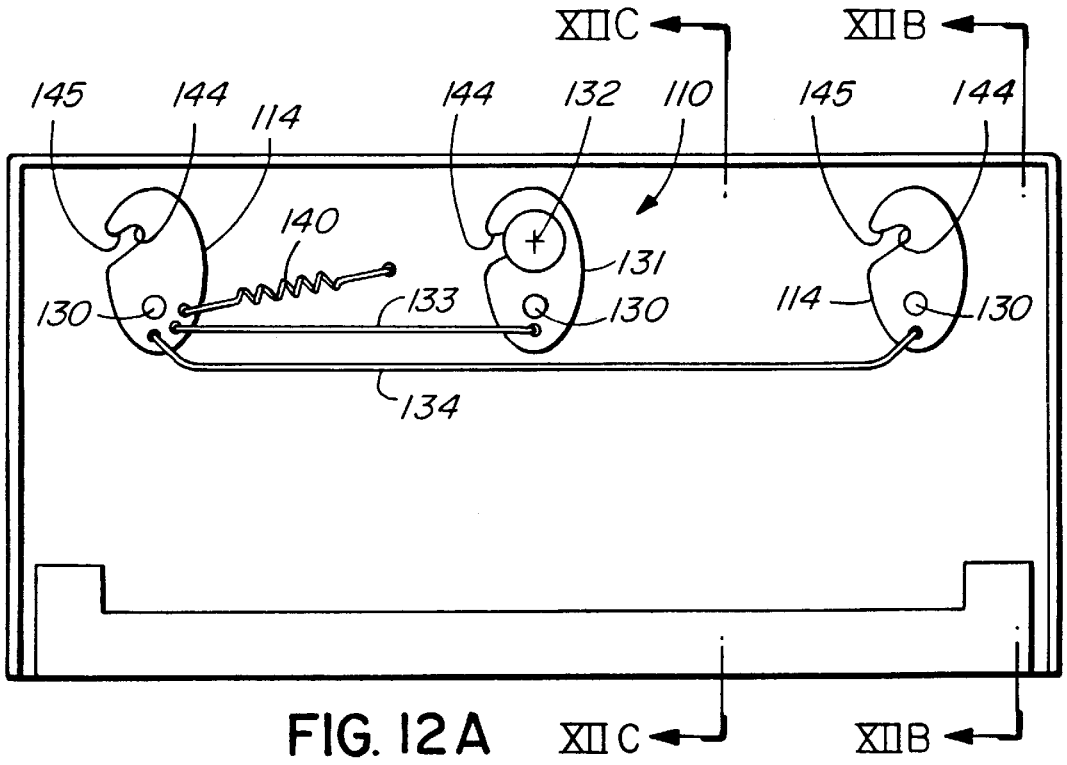
FIG. 12 is a diagrammatic rear or interior view of the door of the security vault of FIG. 8 particularly illustrating the interconnected locking pawl members.
Figure 12B:
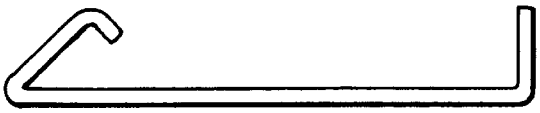
Figure 12C:
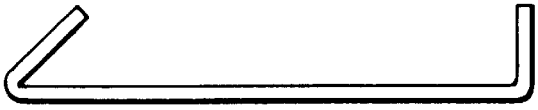

Body 101 extends beneath strength band 103 (FIG. 9) and then bends inwardly toward the central area of 10 the vault 100 where it is welded to an L-shaped steel metal member 111. A loop 112, conveniently made from ¼ inch steel rod stock, is welded to L-member 111 after insertion through hole 113 in strength band 103 and body 101. The top of loop 112 is welded into the strength band 103 and, when the vault 100 is assembled into final configuration, the welds are filed to a position flush with the top of strength band 103 and, when painted, are not visible. Conveniently, three(3) loops 112 are used, one for each of the locking pawls 114 of the locking pawl assembly 110 as seen in FIG. 12.

Door 102 has rounded edges throughout its perimeter. When in the closed condition, edge 120 extends inwardly between the recess defined between L-member 111 and strength band 103. This is similar not only on the top of the vault 100 as illustrated but along the sides as well.

Figure 10:
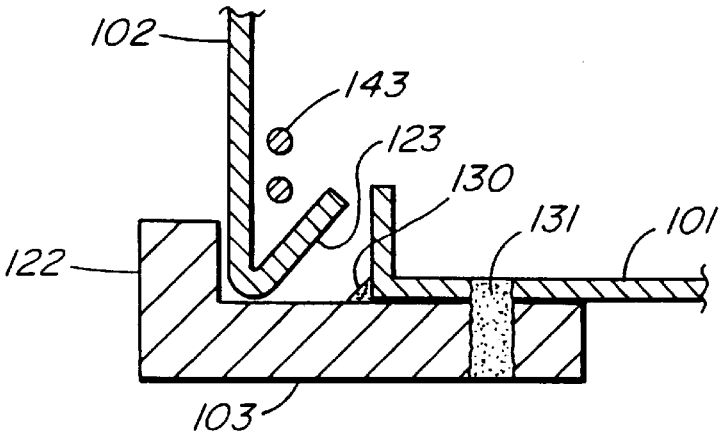
FIG. 10 is a diagrammatic cross-sectional view of the lower door portion of the security vault taken along X—X of FIG. 8.

At the bottom of the door 102 as viewed in FIG. 10, strength band 103 has a bottom leg 122 which extends vertically a distance sufficient to protect and prohibit access to the bottom area of door 102. Door 102 has a rounded bottom edge 123 for reinforcement which extends upwardly and, in the vicinity of the hinge points, has tabs 124 (FIG. 11A) which extend over and protect the pins 143, conveniently two(2) at the hinge points.

As illustrated in FIG. 10, body 101 is welded to strength band 103 by plug welds 131 made at intervals around the perimeter of the body 101 and strength band 103 to securely connect the members 101, 103 and to reduce or eliminate any space between the members 101, 103 which may be used to insert a tool and also to serve as complementary strength members in the unlikely event a tool is successfully inserted between the two members 101, 103.

The pawl or latch assembly 110 is illustrated in FIG. 12. Two outside locking pawls 114 are individually hinged about axes 130 and the central locking pawl 131 is hinged about axis 132 which is conterminous with the axis of the keylock 104; that is, keylock 104 rotates in a circular housing in door 102 and the rotation of keylock 104 occurs about an axis which is coincident with axis 132 of locking pawl 131.

The locking pawls 114, 131 are interconnected using steel rods 133, 134. Rod 133 extends between central locking pawl 131 and leftwardly located locking pawl 114. Rod 134 extends between leftwardly located locking pawl 114 and rightwardly located locking pawl 114. Accordingly, when the keylock 104 is rotated, all of the locking pawls 114, 131 simultaneously rotate with the keylock 104.

The locking pawls 114, 131 are biased towards the locked or counterclockwise position as viewed in FIG. 12 by tension spring 140. Spring 140 is connected to leftwardly located locking pawl 114 below the axis of rotation 130. Thus, spring 140 will continuously exert a counterclockwise moment force on locking pawl 114 which is transmitted to the remaining locking pawls 131, 114 by rods 133, 134.

The upper portion 145 of the recess 144 of each of the locking pawls 114, 131 is intended to be in a closely adjacent or contacting relationship with the respective loop 112 when the locking pawls 114, 131 are in the locked position. This relationship is intended to bring the pawls 114, 131 into contact with their respective loops 112 thereby allowing the loops 112 to serve as backup and reinforcement members for pawls 114, 131 in the event of tool tampering with the closed vault 100.

Figure 13:
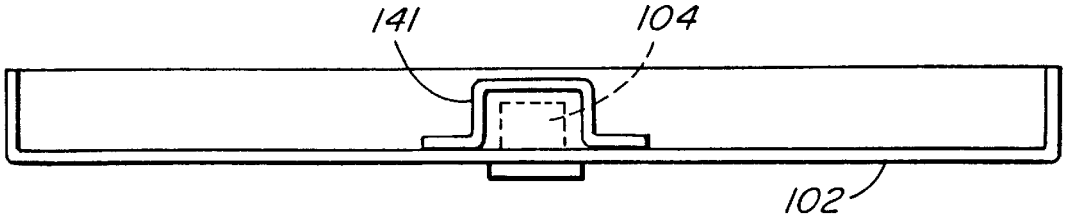
FIG. 13 is a diagrammatic elevation view of the door particularly illustrating the anti-punchout strip used to protect the keylock assembly.

Keylock 104 extends through door 102 into the interior of the vault 100 as best seen in FIG. 13 and is operably connected to locking pawl 131 (FIG. 12). Keylock 104 has a rotatable collar 141 which avoids rotation of the keylock 104 itself in the event it is attempted to attach pliers or vicegrips to the collar 141 or outside of keylock 104. An anti-punchout strip 142 is welded to the interior of door 102. Anti-punchout strip 142 is intended to prevent an attempt to punchout the keylock 104 from the outside of door 102 which, if attempted, allows the keylock 104 to move rearwardly only a small distance before it contacts the anti-punchout strip 142 which will not affect the locking action of the pawl assembly 110.

In operation, it will be assumed that the vault box 100 is in the opened position; that is, the door 102 will be open and items which are intended to be secured are placed in the interior of the security vault 100. The key (not illustrated) of the keylock 104 will be entered into the keylock 104 and rotated in order to move the locking pawl 131 and, thence, locking pawls 114 in a clockwise direction. The key is conveniently a high security key which is difficult to duplicate.

With the locking pawls 114, 131 is the clockwise position, the door 102 will be closed. Door 102 rotates about pins 143 (FIGS. 10 and 11A) and will assume the closed position illustrated. The edge of door 102 around the top and sides of door 102 will extend into the recess carefully constructed between the L-member 111 welded to body 101 and strength band 103. Thus, any tool insertion between the door 102 and the strength band 103 which is successful will only result in a redundant further piece of steel, namely L-member 111, bearing the force of the inserted tool and this force is further diffused by the redundant further attachment of the L-member 111 to the body 101 by locking attachment loops 112.

Further, the use of the three(3) locking pawls 114, 131 results in a force transfer to the remaining pawls if a single one of the locking pawls 114, 131 is the subject of tampering force. Thus, redundant or backup load members are available to complement the strength of a single one of the locking pawls 114, 131.

Figure 11A:
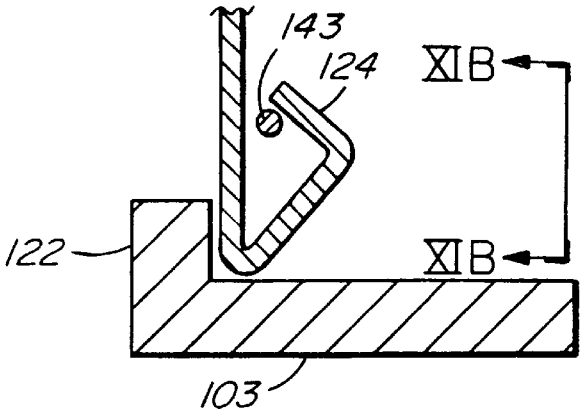
FIG. 11A is a diagrammatic cross-sectional view of the lower door portion of the security vault of FIG. 8 particularly illustrating the door pin hinges.
Figure 11B:
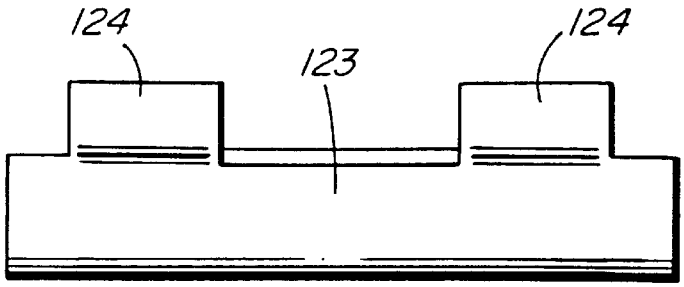
FIG. 11B is a diagrammatic rear or interior view of the door particularly illustrating the tabs used for protecting the pins about which the door rotates between open and closed positions.

At the bottom of door 102, strength band 122 extends upwardly as seen in FIG. 10 to protect access between the bottom of door 102 and the strength band 103. The force of any successful tool insertion between the strength band 103 and the bottom of door 102 will result in the force being taken up and thereby diffused by rounded edge 123 which, in the vicinity of the hinges 143, is further reinforced by the tabs 124 covering the pins 143 which tabs 124 then join with the door 102 (FIG. 11B).

Figure 9:
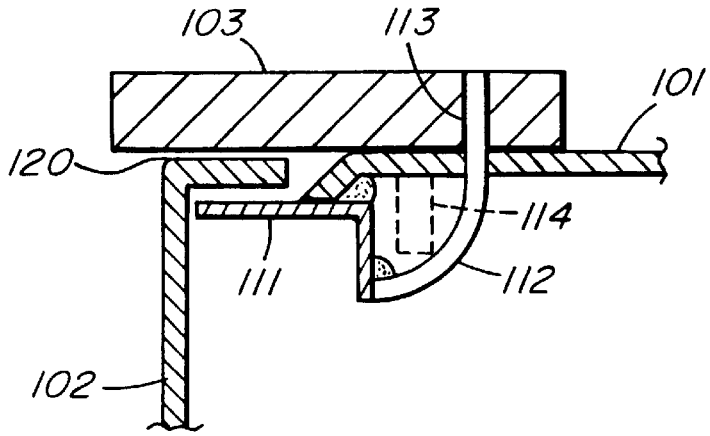
FIG. 9 is a diagrammatic cross-sectional view taken along IX—IX of FIG. 8 particularly illustrating the loops adapted to accommodate the locking pawls, the end areas of the body of the vault at its open end and the configuration of the door of the security vault of FIG. 8.

The key is then released and the spring biased locking pawls 114, 131 will extend over and contact the loops 112 as best seen in FIG. 9. The recesses 144 of the locking pawls 114, 131 will bear against the locking loops 112 in order to remove any play between the locking pawls 114, 131 and loops 112 because of the biasing action of spring 140.

Accordingly, it will be seen that there is a fail-safe type design to the security vault 100 according to this embodiment of the invention. This is so since any attempt to break into the security vault 100 will not succeed if a single member is damaged. Each member depends on and is backed up by a second member and the diffusion of the force caused by the successful insertion of a tool is accomplished by the presence of such member redundancy.

It is contemplated that the loops 112 and the inside configuration of recesses 144 of the locking pawls 114, 131 may take on complementary configurations or shapes other than the round configuration disclosed. For example, complementary octagonal or hexagonal shapes could embrace the locking action between loops 112 and pawls 114, 131 to deter further any attempt to separate the members other than by properly using the keylock 104.

While specific embodiments of the invention have been described, such descriptions are illustrative of the invention only and not as limiting its scope as defined in accordance with the accompanying claims.

I claim:

1. Security vault to protect valuables comprising a body having an open end, a strength band surrounding the perimeter of said body at said open end and being connected to said body, a door operably mounted in said open end of said body defining open and closed positions and having an edge portion, said strength band and said body defining a recess between said strength band and said body, said edge portion of said door being operable to enter said recess when said door is in said closed position, said recess being parallel to said edge portion and said strength band and a locking loop connected between said strength band and said body, said locking loop being operable to receive a locking pawl, said locking pawl being operably mounted on said door.

2. Security vault as in claim 1 wherein said door has a perimeter, said perimeter being rectangular and having a top and sides, said edge portion of said door extending around said top and sides of said door.

3. Security vault as in claim 2 wherein said door has a bottom, said bottom of said door having a rounded edge, said rounded edge extending upwardly to reinforce said bottom of said door.

4. Security vault as in claim 3 wherein said door rotates about pins operably connected to said strength band.

5. Security vault as in claim 4 wherein said strength band has a lower forward area, said lower forward area extending upwardly a distance to cover said bottom of said door.

6. Security vault as in claim 5 and further comprising a locking pawl assembly operably connected to said door.

7. Security vault as in claim 6 wherein said locking pawl assembly comprises a plurality of pawls, each of said pawls being movable between locked and unlocked positions, said plurality said pins.

8. Security vault as in claim 7 wherein said pawls are rotatable between said locked and unlocked positions, said pawls being biased towards said locked position by a spring.

9. Security vault as in claim 8 and further comprising protective tabs extending over said pins of said door.

10. Security vault as in claim 9 and further comprising a keylock mounted in said door and being operably connected to said locking pawl assembly.

11. Security vault as in claim 10 wherein said keylock extends through said door to said locking pawl assembly.

12. Security vault as in claim 11 wherein said door has an interior and further comprising an anti-punchout strip connected to said interior of said door, said anti-punchout strip operably covering the rearwardmost portion of said keylock.

13. Security vault as in claim 12 wherein said pawls of said locking pawl assembly are biased into contact with said loops by said spring when said door is in its closed position.

14. Security vault as in claim 13 wherein said keylock has a round collar on the outward face of said door, said collar being rotatable relative to said keylock.

15. Security vault as in claim 14 wherein said locking pawls and said loops have complementary fitting configurations.

16. Security vault as in claim 15 wherein said complementary fitting configuration is hexagonal or octagonal.

17. Security vault as in claim 1 wherein said door has a front planar portion and hinges, said hinges being located behind said front planar portion of said door and not visible to a viewer when said door is in said closed position.

18. Security vault as in claim 1 wherein said body includes a metal member operably connected to said body and extending substantially parallel to and a distance inwardly of said strength band, said recess being defined by said distance inwardly of said strength band and extending to said metal member.

* * * * *